US008843282B2

(12) United States Patent
Atkinson

(10) Patent No.: US 8,843,282 B2
(45) Date of Patent: Sep. 23, 2014

(54) MACHINE, CONTROL SYSTEM AND METHOD FOR HOVERING AN IMPLEMENT

(75) Inventor: David C. Atkinson, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 101 days.

(21) Appl. No.: 13/287,334

(22) Filed: Nov. 2, 2011

(65) Prior Publication Data

US 2013/0108403 A1 May 2, 2013

(51) Int. Cl.

| | |
|---|---|
| ***E02F 9/20*** | (2006.01) |
| ***E02F 3/36*** | (2006.01) |
| ***G06F 19/00*** | (2011.01) |
| ***E02F 3/43*** | (2006.01) |
| ***E02F 9/26*** | (2006.01) |

(52) U.S. Cl.

CPC ..... *E02F 9/2041* (2013.01); *E02F 3/439* (2013.01); *E02F 3/434* (2013.01); *E02F 9/265* (2013.01)

USPC ..... 701/50

(58) Field of Classification Search

CPC ..... E02F 9/265; E02F 9/2041; E02F 3/434; E02F 3/439

USPC ..... 701/50

See application file for complete search history.

(56) References Cited

U.S. PATENT DOCUMENTS

| | | | | |
|---|---|---|---|---|
| 4,844,685 | A | 7/1989 | Sagaser | |
| 4,934,463 | A * | 6/1990 | Ishida et al. | 172/4.5 |
| 5,000,650 | A | 3/1991 | Brewer et al. | |
| 5,052,883 | A | 10/1991 | Morita et al. | |
| 5,261,495 | A * | 11/1993 | Szymczak | 172/2 |
| 5,469,694 | A * | 11/1995 | Panousheck et al. | 56/10.2 E |
| 5,884,204 | A * | 3/1999 | Orbach et al. | 701/50 |
| 6,085,846 | A * | 7/2000 | Buchl et al. | 172/4 |
| 6,275,757 | B1 * | 8/2001 | Watanabe et al. | 701/50 |
| 6,278,955 | B1 * | 8/2001 | Hartman et al. | 702/105 |
| 6,640,163 | B1 * | 10/2003 | Pfaff et al. | 700/282 |
| 6,757,994 | B1 | 7/2004 | Hendron | |
| 6,766,236 | B1 * | 7/2004 | Lamela et al. | 701/50 |
| 7,079,931 | B2 * | 7/2006 | Sahm et al. | 701/50 |
| 7,676,967 | B2 | 3/2010 | Gharsalli et al. | |
| 7,686,095 | B2 * | 3/2010 | Batthala et al. | 172/2 |
| 7,845,169 | B2 | 12/2010 | Brickner et al. | |
| 8,406,955 | B2 * | 3/2013 | Iwami et al. | 701/37 |
| 2002/0072850 | A1 * | 6/2002 | McClure et al. | 701/213 |
| 2004/0060711 | A1 | 4/2004 | Charles | |
| 2006/0263189 | A1 * | 11/2006 | Vigholm | 414/685 |
| 2007/0010925 | A1 * | 1/2007 | Yokoyama et al. | 701/50 |
| 2007/0175210 | A1 * | 8/2007 | Beck et al. | 60/464 |
| 2008/0005938 | A1 * | 1/2008 | Aebischer et al. | 37/413 |
| 2008/0257569 | A1 * | 10/2008 | Foster et al. | 172/9 |
| 2008/0257570 | A1 * | 10/2008 | Keplinger et al. | 172/9 |

(Continued)

FOREIGN PATENT DOCUMENTS

| | | |
|---|---|---|
| JP | 1239231 | 9/1989 |
| KR | 20-1996-0008840 Y1 | 10/1996 |

*Primary Examiner* — Calvin Cheung
*Assistant Examiner* — Allen E Quillen
(74) *Attorney, Agent, or Firm* — Liell & McNeil

(57) ABSTRACT

A machine such as a wheel loader includes a frame and ground engaging propulsion elements coupled with the frame. A hydraulically actuated implement system of the machine includes a linkage and an implement and is adjustable from a starting configuration to a second configuration according to a substrate collision avoiding pattern. In the second configuration, the implement hovers above a substrate beneath the machine. Related methodology and control logic is also disclosed.

18 Claims, 4 Drawing Sheets

(56) References Cited

U.S. PATENT DOCUMENTS

| | | | | |
|---|---|---|---|---|
| 2009/0112413 | A1* | 4/2009 | Eastman et al. | 701/54 |
| 2009/0112414 | A1* | 4/2009 | Eastman et al. | 701/54 |
| 2010/0287898 | A1* | 11/2010 | Ringwald et al. | 56/10.2 E |
| 2010/0287900 | A1* | 11/2010 | Ringwald et al. | 56/17.1 |
| 2011/0153168 | A1* | 6/2011 | Peterson et al. | 701/50 |
| 2011/0276222 | A1* | 11/2011 | Lougheed et al. | 701/35 |
| 2011/0282556 | A1* | 11/2011 | Klenz et al. | 701/50 |
| 2012/0095654 | A1* | 4/2012 | Miller et al. | 701/50 |
| 2012/0155999 | A1* | 6/2012 | Morimoto et al. | 414/685 |
| 2012/0185141 | A1* | 7/2012 | Kamado et al. | 701/50 |
| 2012/0310494 | A1* | 12/2012 | Asami et al. | 701/50 |
| 2012/0330515 | A1* | 12/2012 | Numazaki et al. | 701/50 |
| 2013/0018552 | A1* | 1/2013 | Foster et al. | 701/50 |
| 2013/0108403 | A1* | 5/2013 | Atkinson | 414/685 |

* cited by examiner

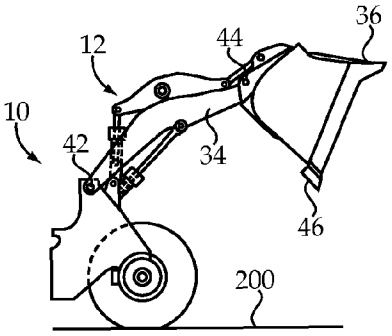
Figure 3a
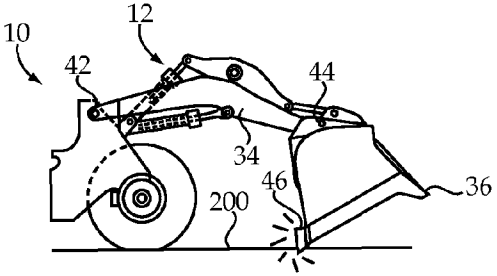
Figure 3b
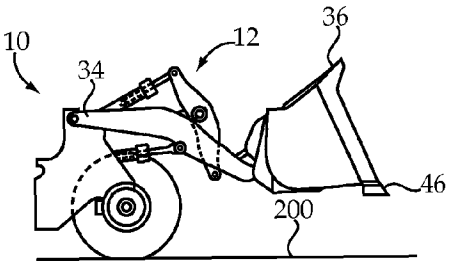
Figure 3c
Figure 3d
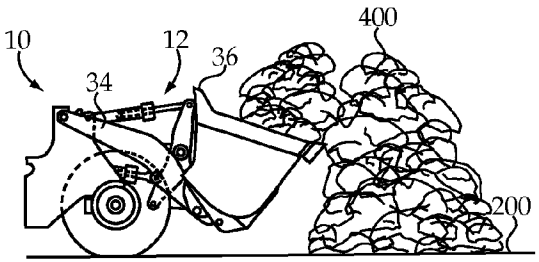
Figure 3e
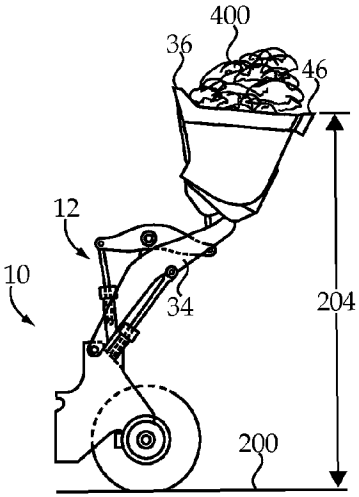
Figure 3f

MACHINE, CONTROL SYSTEM AND METHOD FOR HOVERING AN IMPLEMENT

TECHNICAL FIELD

The present disclosure relates generally to electro-hydraulic control strategies for implement systems in ground engaging machines, and relates more particularly to controllably hovering an implement above a substrate beneath a machine.

BACKGROUND

Hydraulically actuated implement systems of many different types are used in a broad variety of machines. Track-type tractors, backhoes, excavators, and wheel loaders are notable examples, having hydraulically actuated implement systems for digging, dozing, loading, spreading and all manner of other activities relating to manipulation of loose material and various other types of loads. Controlling a hydraulically actuated implement system with even reasonable efficiency and accuracy is by no means simple. Operators are typically tasked with manually manipulating various control levers while monitoring multiple operating conditions of the machine, whether stationary or traveling. It is thus unsurprising that even highly skilled operators with decades of experience are often able to improve performance with the assistance of various electronically controlled features of hydraulically actuated implement systems.

Over the years, engineers have proposed a great many different strategies for automating work cycles or parts thereof, such as material loading cycles whereby a machine captures, lifts and dumps material. Rather than requiring an operator to manually and repetitiously raise and lower the machine's lift arms, control tilting of the machine's bucket, and monitor and control the travel path and speed of the machine itself, a computer controls some or all of the functions of the implement system so that an operator can focus his attention elsewhere, or simply avoid fatigue.

Other examples of computer controlled processes include grading, trenching, and virtually any other common activity which can be performed by a human operator. Despite substantial advances in automated machine process technology, there nevertheless remain many instances where skilled operators can best computers in relation to at least certain aspects of a machine process, or where handing over control of an implement system to a computer for the totality of a work cycle is undesirable for other reasons. In still other instances, designing and implementing computer control for all aspects of a work cycle has proven to be very challenging, and often unnecessary to achieve real world efficiency gains. There thus remain ample opportunities for automating parts of machine work cycles, while leaving other parts to be controlled conventionally by an operator or by a separate control routine.

One example of an automated control strategy for a construction machine is known from U.S. Pat. No. 5,052,883 to Morita et al. In Morita et al., a work vehicle has an implement position controller. The controller is configured to automatically orient and position an implement, such as a bucket coupled with a linkage in a wheel loader. While Morita et al. appears to be an elegant strategy for attaining a pre-defined bucket orientation and position, especially for certain types of work cycles, there is always room for improvement, especially as new problems are recognized or created.

SUMMARY

In one aspect, a method of controlling a hydraulically actuated implement system having a linkage and an implement, in a self-propelled ground engaging machine, includes electronically reading a stored value which is linked with a starting configuration of the implement system, responsive to an implement hover command, and outputting a control signal to the implement system which is based at least in part on the stored value. The method further includes actuating the implement system responsive to the control signal, such that the implement system moves according to a substrate collision avoiding pattern from the starting configuration to a second configuration at which the implement hovers above a substrate beneath the machine.

In another aspect, a control system for a hydraulically actuated implement system having a linkage and an implement, in a self-propelled ground engaging machine, includes a computer readable memory storing a value linked with a starting configuration of the implement system. The control system further includes an electronic control unit coupled with the computer readable memory and configured to read the stored value, in response to an implement hover command. The electronic control unit is further configured to output a control signal to the implement system which is based at least in part on the stored value, such that the implement system moves according to a substrate collision avoiding pattern from the starting configuration to a second configuration at which the implement hovers above a substrate beneath the machine.

In still another aspect, a machine includes a frame and ground engaging propulsion elements coupled with the frame. The machine further includes a hydraulically actuated implement system having a linkage and an implement, and an electronic control unit in control communication with the implement system. The electronic control unit is configured to adjust the implement system from a starting configuration to a second configuration at which the implement hovers above a substrate beneath the machine. The electronic control unit is further configured to receive data indicative of the starting configuration and responsively adjust the implement system to the second configuration according to a substrate collision avoiding pattern.

BRIEF DESCRIPTION OF THE DRAWINGS

FIG. 3*a* is a side diagrammatic view of the machine of FIG. 1 at one stage of a work cycle, according to one embodiment;

FIG. 3*b* is a side diagrammatic view of a machine operated according to a conventional control strategy and illustrating collision of an implement with a substrate;

FIG. 3*c* is a side diagrammatic view of the machine of FIG. 1 at another stage of the work cycle;

FIG. 3*d* is a side diagrammatic view of the machine of FIG. 1 at yet another stage of the work cycle;

FIG. 3*e* is a side diagrammatic view of the machine of FIG. 1 at yet another stage of the work cycle;

FIG. 3*f* is a side diagrammatic view of the machine of FIG. 1 at yet another stage of the work cycle.

DETAILED DESCRIPTION

Figure 1:
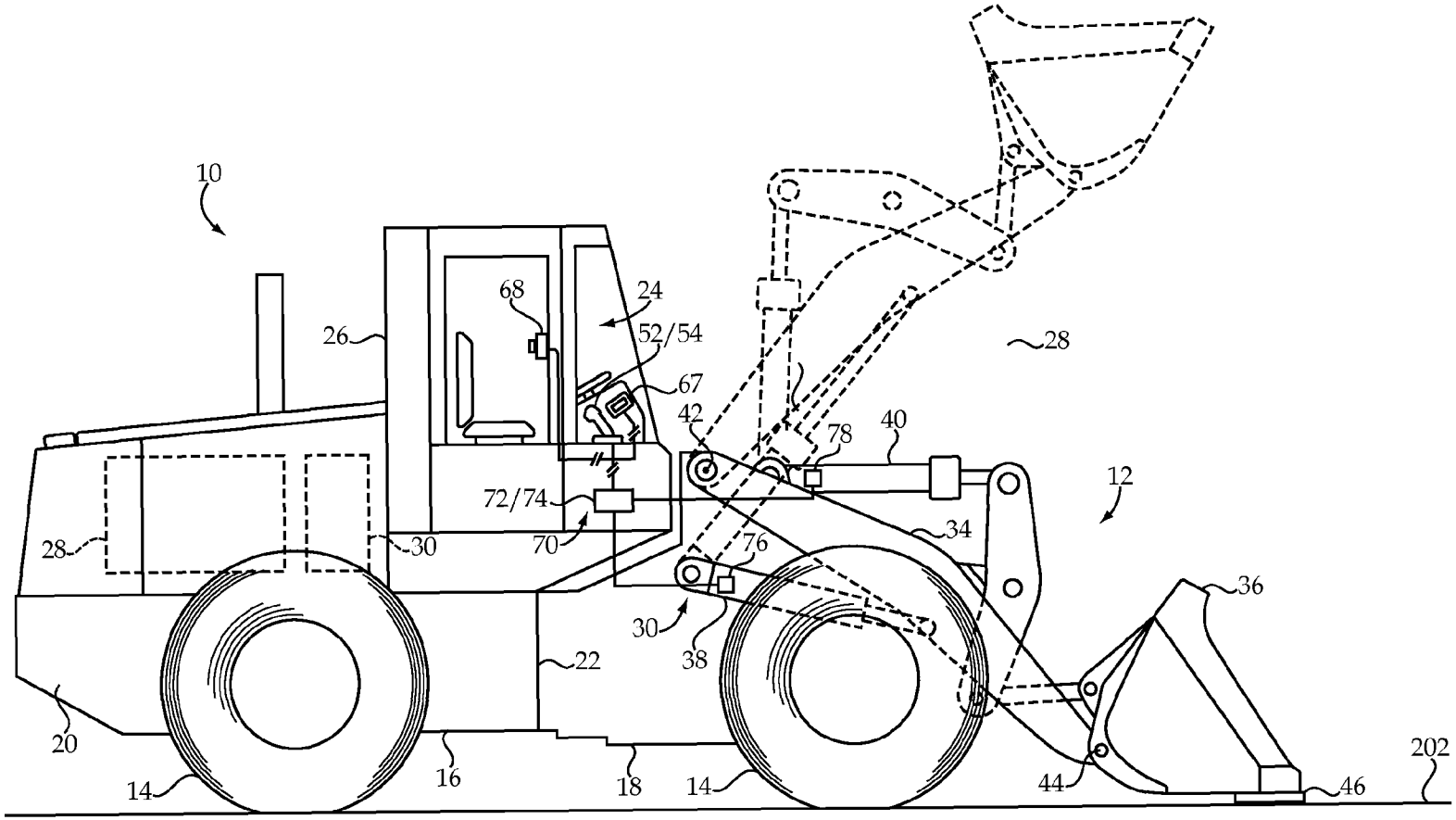
FIG. 1 is a side diagrammatic view of a machine, according to one embodiment.

Referring to FIG. 1, there is shown a self-propelled, ground-engaging machine 10 according to one embodiment.

Machine 10 includes a frame 16 having a front frame unit 18, a back frame unit 20, and an articulation joint 22 coupling together frame units 18 and 20. An internal combustion engine 28 is mounted to frame 16, as is an operator cab 26. A set of ground engaging propulsion elements 14 are coupled with frame 16 in a conventional manner for propelling machine 10. In the illustrated embodiment, propulsion elements 14 are shown as wheels, however, tracks might be used in an alternative embodiment. A hydraulically actuated implement system 12 is coupled with frame 16, and includes a linkage 34 coupled with an implement 36. Linkage 34 may include a plurality of lift arms, one of which is visible in FIG. 1, but might include a single lift arm or boom in certain embodiments. Linkage 34 may be raised and lowered relative to frame 18 about a pivot axis 42, whereas implement 36 may be rotated about another pivot axis 34 relative to linkage 34.

Machine 10 may further include a hydraulic system 30 which includes a lift actuator 38 configured to raise and lower linkage 34 relative to frame 18, and a tilt actuator 40 configured to rotate implement 36 relative to linkage 34. Actuators 38 and 40 may be connected via hydraulic lines (not shown) with other components of hydraulic system 30 for supply and return of fluid in a conventional manner. In the illustrated embodiment, implement 36 includes a bucket, but in alternative embodiments could include a fork, a blade, a rotary broom or still another type of implement. A substrate protection pad 46 may be coupled with implement 36 for contacting a substrate 200 beneath machine 10. Substrate protection pad 46 may include a rubber pad adapted to prevent scraping, scuffing or other damage to substrate 200, as well as preventing damage to implement 36 itself when machine 10 travels across substrate 200 with implement system 12 in a fully lowered position.

An operator control station 24 may be located in cab 26, for controlling and operating various aspects of machine 10, including a set of control levers 52/54, one of which is shown in FIG. 1, a throttle 67 and an operator input device 68. The operator controlled devices of control station 24 may connect with a control system 70 for machine 10, which is configured for controlling various aspects of operation of implement system 12 as further described herein.

Control system 70 may include a computer readable memory 72, and an electronic control unit 74 coupled with computer readable memory 72. Control system 70 may further include a group of sensors, including a first sensor 76 configured to sense a position of actuator 38, and a second sensor 78 configured to sense a position of actuator 40. Each of sensors 76 and 78 may be coupled with electronic control unit 74 to enable monitoring of a position of each of linkage 34 and implement 36. While linear position sensors might be used, in other strategies rotary sensors such as rotary potentiometers, digital cameras or laser sensors might be used. In any event, inputs from sensors 76 and 78 to electronic control unit 74 can enable the monitoring of not only position, but also travel direction and speed of actuators 40 and 38, and this position, speed, and travel direction of linkage 34 and implement 36. This enables electronic control unit 74 to determine a configuration of implement system 12, or monitor a change in configuration of implement system 12, relative to other parts of machine 10 and/or relative to substrate 200 at any time, the significance of which will be apparent in view of the following description.

Figure 2:
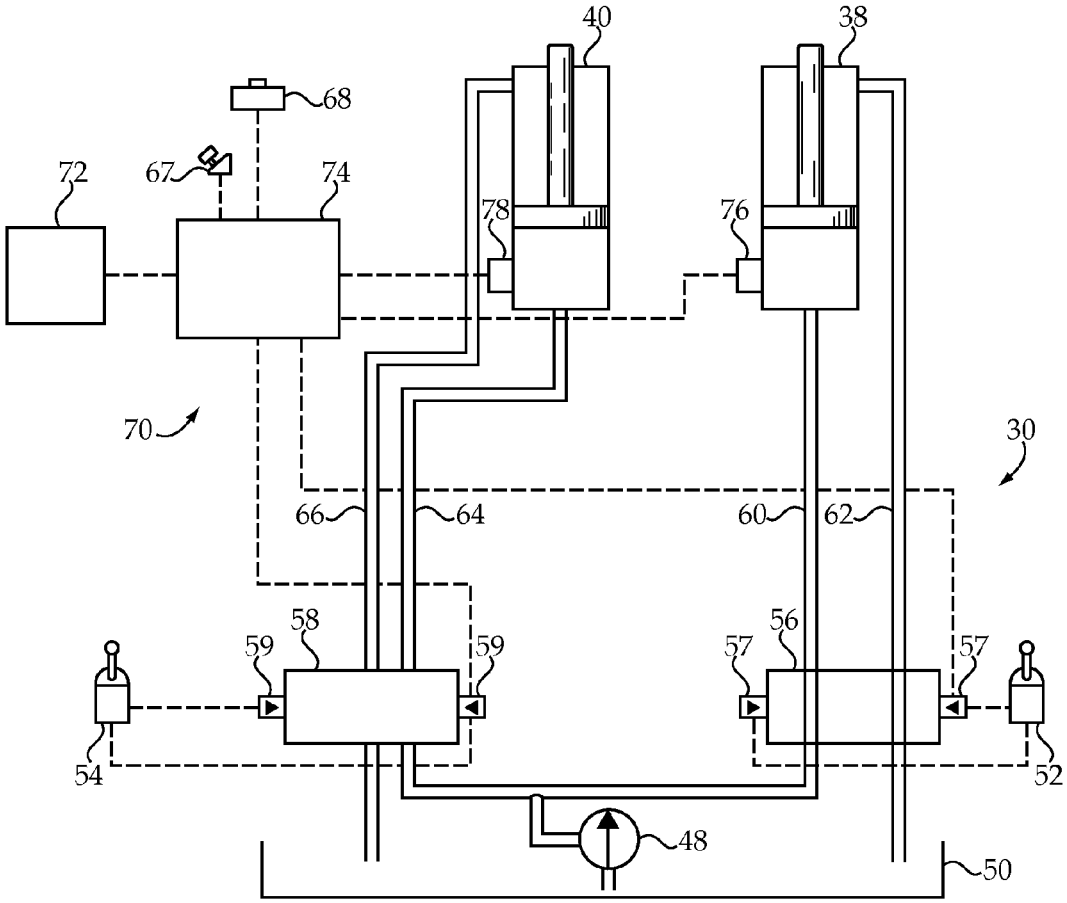
FIG. 2 is a diagrammatic view of a hydraulically actuated implement system, and control system therefor, according to one embodiment.

Referring now also to FIG. 2, there is shown a diagrammatic view of certain parts of machine 10, including control system 70 and hydraulic system 30. Hydraulic system 30 may include a tank 50 and a pump 48. Hydraulic fluid may be conveyed between tank 50 and each of actuators 38 and 40 by way of a first head-side conduit 60 and a second head-side conduit 64, respectively, and a first rod-side conduit 62 and a second rod-side conduit 66. Hydraulic system 30 may further include a first control valve 56 for controlling fluid flow to and from actuator 38, and a second control valve 58 similarly associated with actuator 40. Each of control valves 56 and 58 may include a known spool valve which may be operated directly or indirectly by way of control levers 52 and 54. In one embodiment, each of control valves 56 and 58 may be electronically controlled, such that manipulating the corresponding control lever 52 or 54 sends a control signal to electronic control units 74, which in turn adjusts a position of the corresponding one of control valves 56 and 58. To this end, each of control valves 56 and 58 may include one or more electrical actuators 57 and 59, respectively, which can adjust a position of the corresponding valve in response to control signals from electronic control unit 74. Electronic control unit 74 may utilize information from sensor 76 and optionally from sensor 78, and in certain instances from throttle 67, to controllably adjust implement system 12 via control signals to actuators 57 and 59 such that implement 36 hovers above substrate 200. Adjusting of implement system 12 may take place based at least in part upon a starting configuration of implement system 12 when hovering is commanded. In particular, implement system 12 may be adjusted in a way which accounts for the starting configuration such that implement system 12 moves according to a substrate collision avoiding pattern from the starting configuration to a second configuration at which implement 36 hovers above substrate 200.

To this end, memory 72 may store a value linked with a starting configuration of implement system 12. Electronic control unit 74 may be configured to read the stored value, in response to an implement hover command such as a command from operator input device 68. The starting configuration of implement system 12 may be understood as a configuration presently occupied by implement system 12 when hovering is commanded. Implement system 12 may assume a wide variety of different possible starting configurations, each defined by a combination of a starting state of linkage 34 about axis 42 and a starting state of implement 36 about axis 44. The starting linkage state may include linkage position, travel direction, and/or travel speed, about axis 42. The implement starting state may include implement position, travel direction, and/or travel speed about axis 44. Data received by electronic control unit 74 from sensors 76 and 78 may be indicative of the starting linkage and implement states, thus enabling electronic control unit 74 to "know" the starting configuration when the implement hover command is received. The pattern of moving implement 36 and linkage 34 through space to reach the second, hovering configuration may thus account for the starting positions of linkage 34 and implement 36, as well as travel direction and travel speed. These factors as well as how in particular electronic control unit 74 may move implement system 12 in consideration of these factors will be further apparent and understood from the following description.

Electronic control unit 74 may be further configured to output a control signal to implement system 12 which is based at least in part on the stored value, such that implement system 12 moves according to the substrate collision avoiding pattern noted above. More than one control signal may be outputted to adjust implement system 12 as desired, and multiple control signals to each of electrical actuators 57 and 59 based upon the stored value as well as upon feedback from sensors 76 and 78 may be used to ultimately reach the hovering configuration reasonably quickly and without colliding with substrate 200. In one embodiment, the stored value may be one of a plurality of values stored on memory 72 and each being linked to a different one of a plurality of possible starting configurations of implement system 12. Thus, while those skilled in the art will appreciate that the number of different possible starting configurations might be essentially infinite, the present control strategy may be understood in at least certain embodiments as treating the number of possible starting configurations as finite, and store a value associated with each one of the finite number of possible starting configurations.

Each of the plurality of stored values may further include an address on memory 72 which includes a starting linkage position coordinate, such as linkage lift height. Thus, the plurality of stored values may be stored in a look up table which has as one of its coordinates linkage lift height. Linkage lift height may therefore be understood as linking each of the stored values to one of the plurality of possible starting configurations. In the look-up table example, each of the plurality of stored values may have an address on memory 74 which might also include a starting implement position coordinate. It will thus be understood that starting linkage position or lift height may serve as a basis for determining how to adjust implement system 12 to the hovering configuration. In expanded or alternative embodiments, starting implement position or tilt angle may be used. As noted above, throttle position may also be factor considered by electronic control unit 72 in determining control signals to output to one or both of electrical actuators 57 and 59, hence, the addresses in the look up table might also include a throttle position coordinate.

Those skilled in the art will appreciate that throttle position may relate to pump speed, in turn relating to actuator speed. A machine at full throttle can be expected to be capable of moving implement system actuators faster than at part throttle, thus affecting what patterns of movement are suitable for adjusting the implement system to a hovering configuration without colliding with the substrate. Still other factors considered upon initiating hovering or serving as the basis for controlling implement system movement in the manner contemplated herein include linkage and/or implement speed, travel direction, and possibly still other factors, as alluded to above. It will thus be understood that upon commencing the hovering control sequence discussed herein, electronic control unit 74 may be broadly obtaining a picture of where implement system 12 is located, and what implement system 12 and the overall machine 10 are currently doing, such that control signals output to implement system 12 can be tailored to move implement system 12 in such a manner that collision with substrate 200 is avoided.

In the interest of minimizing the time it takes to move various parts of an implement system to a desired position, many electro-hydraulic control systems are configured such that actuator speed and thus implement system speed is as fast as practicable. In other words, in a conventional electro-hydraulic implement system, it is common for an electronic control unit to command a control valve to be moved to a position which corresponds to maximum actuator velocity. Those skilled in the art will appreciate, however, that were such a control strategy to be used unmodified to command hovering of an implement relatively close to a substrate, in at least certain instances there would be a risk that the linkage or implement would move too slowly too fast, too soon, or too late to avoid collision of the implement with the substrate. For instance, if linkage lowering to a hover position is commanded in an electro-hydraulically controlled machine with the linkage raised and bucket uncurled, then rapidly lowering the linkage all the way without curling the bucket out of the way could cause the bucket to crash into the substrate. Collision could thus occur unless the bucket is itself commanded to rack back or curl quickly enough to make it out of the way before the linkage is lowered. The present disclosure addresses these and other concerns by enabling at least the linkage, and optionally implement, control signals to be modified from a default or otherwise calculated such that the implement system smoothly, and without colliding with the substrate is adjusted to a hovering configuration. By utilizing a stored gain for control signals to either or both of actuators 57 and 59, signals are determined which will move actuators 38 and 40 such that collision with the substrate is avoided. It will further be understood that rather than utilizing values stored in a table, an equation might be utilized which enables control unit 74 to calculate appropriate control signals for these purposes on the fly.

Referring now also to FIG. 3*a*, there is shown a portion of machine 10 including implement system 12 as it might appear having just dumped a load of material from implement 36. Linkage 34 is raised to or close to a maximum lift height, and implement 36 is tilted forward, or uncurled, such that material may be dumped from implement 36 into a truck, pile or the like. From the state shown in FIG. 3*a*, an implement hover command may be outputted via operator input device 68 to initiate adjusting implement system 12 to a hovering configuration. Referring now to FIG. 3*b*, there is shown implement system 12 as it might appear where moving of implement system 12 to a hovering configuration has been commanded without accounting for the starting configuration of implement system 12. Linkage 34 has been lowered, but implement 36 has been tilted, or curled, very little, if at all, from the state shown in FIG. 3*a*. As a result, implement 36 has collided with substrate 200. Another way to understand what is depicted in FIG. 3*b*, is that linkage 34 has been lowered more quickly than implement 36 has been tilted out of the way.

In FIG. 3*c*, implement system is shown in a configuration it might occupy where linkage 34 and implement 36 have both been adjusted, according to the substrate collision avoiding pattern discussed herein, such that linkage 34 has lowered part way, and implement 36 has tilted much or all of the way, needed to assume the hovering configuration. In FIG. 3*d*, implement system 12 has been still further adjusted such that implement 36 hovers above substrate 200 as machine 10 travels forward to engage with a material pile 400. In FIG. 3*d*, implement system 36 hovers at a distance 202 above substrate 200 which may be as small as a few inches, for instance, about 12 inches or less. In FIG. 3*e*, hovering has been deactivated, for instance in response to the operator manipulating control levers 52/54, and linkage 34 has begun to be raised while implement 36 has begun to be racked back, to fill implement 36 with material from pile 400. In FIG. 3*f*, implement system 12 is shown as it might appear where linkage 34 is fully raised with implement 36 containing a full load of material. From the state shown in FIG. 3*f*, machine 10 may be backed away from the material pile, and implement system 12 returned to a configuration such as that shown in FIG. 3*a* to dump the material. In FIG. 3*f*, implement 36 is shown at a lift height 204 which is approximately a maximum lift height, measured via a linear distance from an outermost tip of substrate protection pad 46 to substrate 200. The distance 202 shown in FIG. 3*d* which represents a hovering height may be equal to about 5% or less of the maximum lift height 204 shown in FIG. 3*f*.

Those skilled in the art will appreciate that machine 10 may be moving forward, backward, or not moving at all, at various of the stages depicted in FIGS. 3*a-f*, as well as at other stages of a capture, lift and dump routine as contemplated herein. Accordingly, during executing a hovering control cycle as described herein, for at least certain of the procedures thereof, machine 10 may be moving. The present disclosure is contemplated to allow an operator to operate machine 10 with greater efficiency than that possible without the teachings set forth herein. In particular, an operator may command implement system 12 to assume a hovering configuration while backing away from a haul truck which has just received a dump load from implement 36, and by the time the operator commences moving machine 10 forward into material pile 400, implement system 12 will have been positioned in the hovering configuration. Rather than separating the operator's attention among positioning implement system 12 and controlling speed and travel direction of machine 10, the positioning of implement system 12 can be turned over to control system 70. Although the present disclosure is not thereby limited, these capabilities can be considered to be especially advantageous in improving efficiency in waste handling applications. In a conventional waster transfer facility, collection trucks routinely arrive and dump loose material onto a substrate such as a relatively smooth and flat concrete floor. A wheel loader such as machine 10 is commonly used to capture and lift the loose material deposited via the collection trucks, and transfer the material into larger haul trucks for transport to a storage site or the like. An operator may thus be performing very similar work cycles with machine 10 over and over. It has been observed that sloppy operation, or operation by inexperienced operators, often results in damage to implements, to the concrete floors of waste transfer stations, or results in premature wear of a substrate protection pad. This is due at least in part to the relative difficulty of manually controlling an implement system such that the implement hovers just above a substrate, and instead the implements are often slid across the transfer station floor. In view of the general similarity of each work cycle executed by the operator, and the predictable flatness and smoothness of the waste transfer floor, the presently described control strategy can hover implement system 12 based upon sensed positions and other characteristics of the components of implement system 12 in a reference frame defined by machine 10. In other words, while in certain environments such as construction or mining a substrate beneath a wheel loader or other machine might not be safely assumed to be smooth and flat, in a waste transfer station the underlying substrate can generally be assumed to be so. For this reason, it is unnecessary to directly sense a distance between implement 36 and substrate 200, and instead implement 36 may be successfully hovered quite close to substrate 200 based upon sensed positions of linkage 34 and implement 36 relative to machine 10 alone.

INDUSTRIAL APPLICABILITY

Figure 4:
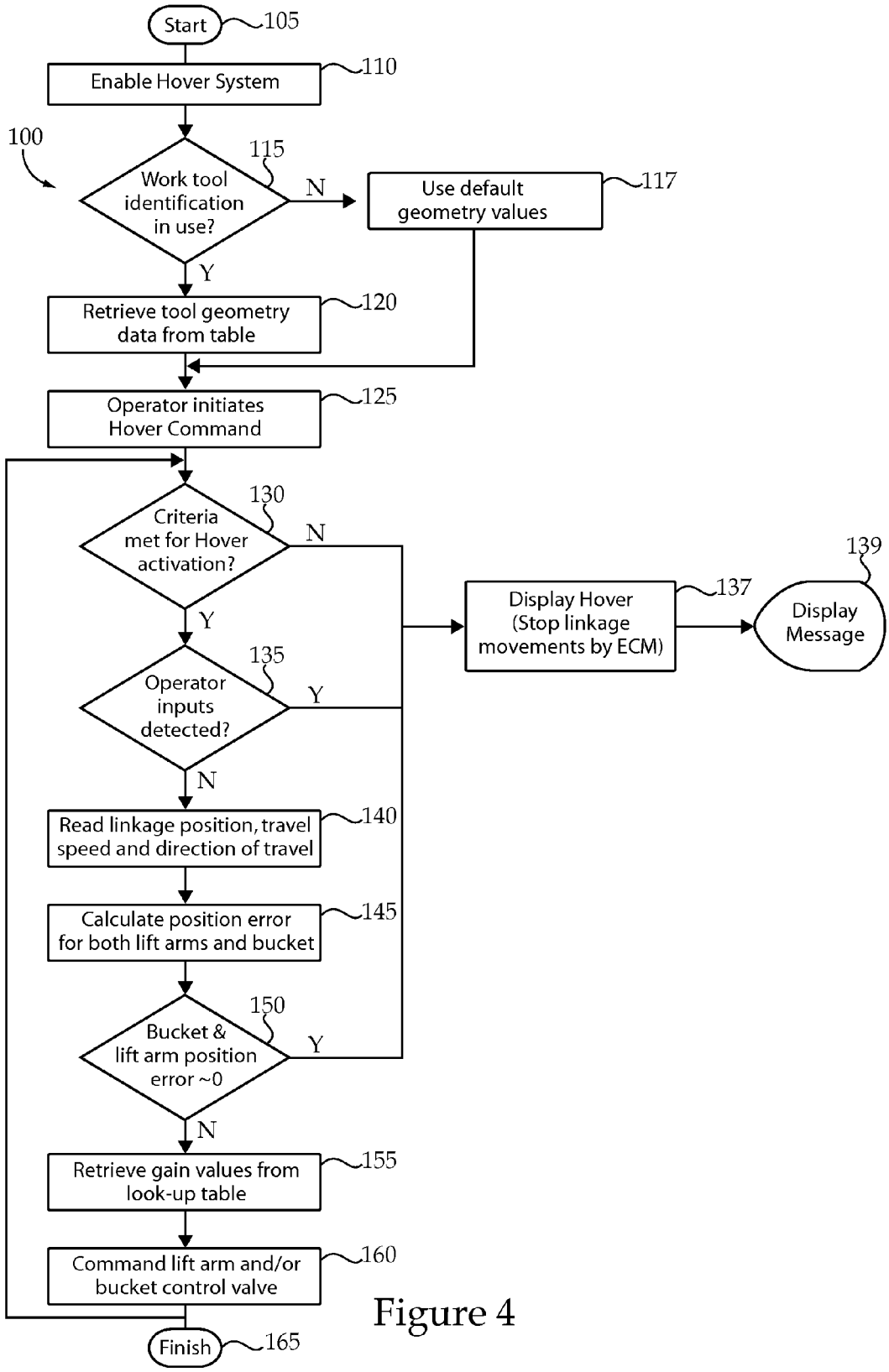
FIG. 4 is a flowchart illustrating a control process according to one embodiment.

Referring now to FIG. 4, there is shown a flowchart 100 illustrating a control process according to the present disclosure. The process of flowchart 100 starts at Step 105, and then proceeds to Step 110 to enable the hover system, in other words initialize control system 70 for controlling implement system 12 in the manner described herein. As discussed above, an operator may repeat the same or a similar work cycle many times during an operating shift on machine 10. Accordingly, each time an operator captures, lifts, and dumps material, prior to or during returning to the pile to capture another load, hovering of implement system 12 may be used, and the "hover system" may be turned on. In other instances, hovering capability may be disabled.

From Step 110, the process may proceed to Step 115, where electronic control unit 74 may query whether work tool identification is in use. Different implements may have different masses, dimensions, and possibly other features which render them best used via a control strategy that accounts for their unique characteristics. For example, while one-size-fits-all hovering control strategies are contemplated herein, since many machines are capable of using different implements such as differently sized buckets, optimal efficiency and an accurate specified hover height may be obtained by considering what type of implement is presently being used. The use of RF (radio frequency) ID tags on implements can enable a control system to determine which implement the machine is currently being used with. To this end, different stored values linked with starting configuration as described herein may be used depending upon implement type. In the context of a look up table, electronic control unit 74 may electronically read a stored value linked with starting configuration of implement system 12, where the stored value is located at an address on memory 72 having an implement type coordinate. Accordingly, where work tool identification is in use, from Step 115 the process may proceed to Step 120 to retrieve tool geometry data from the stored table. If work tool identification is not in use at Step 115, the process may proceed to Step 117 to use default geometry values. From either of steps 120 or 117, the process may proceed to Step 125 at which the operator initiates the hover command.

As discussed above, the hover command may be initiated via operator input device 68. In one embodiment, input device 68 might include a push button, switch or the like, having a total of two states such as an on state or an off state. In other words, in contrast to other types of input devices such as control levers used for controlling actuators 38 and 40, input device 68 may include a simple switch or button which enables the operator to output the hover command, and then return their attention to other aspects of controlling machine 10. From Step 125, the process may proceed to Step 130 at which electronic control unit 74 may query whether criteria are met for hover activation. In some instances, limits might be placed on hovering for certain lift arm or bucket positions, combinations thereof, ground speeds or machine or implement travel directions. For example, control system 70 might be configured such that hover criteria are not satisfied if machine 10 is backing up or traveling above a certain speed. If the criteria are not met, then the process may proceed from Step 130 to Step 137 to disable hover, for example stopping linkage and implement movements via control unit 74. From Step 137 the process may proceed to Step 139 to display a message such as an alert, fault or error message via a display screen or other operator perceptible mechanism at control station 24.

If, at Step 130, the criteria are satisfied for hover activation, the process may proceed to Step 135 at which electronic control unit 74 may query whether operator inputs are detected. At Step 135, electronic control unit 74 may be understood as determining whether the operator is attempting to manually manipulate implement system 12 via control levers 52/54. If yes, the process may proceed to Step 137 to disable hover. If no, the process may proceed to Step 140 at which electronic control unit 74 may read linkage position, linkage travel speed, and linkage travel direction, such as via inputs from sensor 76. Additionally, at Step 140, electronic control unit 74 might also evaluate implement position, travel speed, and/or travel direction, and/or receive data indicative of throttle position. While implement system 12 will typically be adjusted from a raised starting configuration to the hovering configuration, an operator might instead command adjusting implement system 12 to the hovering configuration from a fully lowered position at which implement 36 is resting upon substrate 200. From Step 140, the process may proceed to Step 145 at which electronic control unit 74 may calculate a position error for both linkage 34 and implement 36. In the case of machine 10 having multiple lift arms, position errors might be calculated for both lift arms. Another way to understand the determination at Step 145 is that electronic control unit 74 is calculating a difference between actual linkage and implement positions and desired positions. From Step 145, the process may proceed to Step 150 at which electronic control unit 74 queries whether bucket and lift arm position errors are approximately zero. If yes, this may be taken as an indication that the hovering set point has been reached, in which case the process may proceed to Step 137 to disable hover. If, at Step 150, the bucket and lift arm position errors are not approximately equal to zero, the process may proceed to Step 155 to retrieve gain values from the stored look-up table as discussed herein.

In many instances, a rate and sequence of implement and linkage movement commands to actuators 38 and 40 may need to adjust throughout the range of motion of linkage 12. For instance, implement 36 may need to be curled or racked back as linkage 34 lowers, to prevent implement 36 from contacting the ground, similar to the depiction in FIG. 3*b* where implement 36 has not been adjusted or not sufficiently adjusted to avoid colliding with substrate 200. In general terms, a speed of rotation of implement 36 about axis 44 and/or a timing of starting rotation of implement 36 may occur responsive to a starting state of linkage 34. For instance, if linkage 34 is in a fully raised position when the hovering command is received, implement 34 may be tilted safely at a relatively slower rate. If linkage 34 is only part way raised, it may be assumed that implement 36 needs to tilt fairly quickly to get out of the way as linkage 34 is lowered. These concerns of course also depend upon how much, if at all, that implement 36 needs to tilt to assume its desired position for hovering. It will thus be understood that a speed of rotation of each of linkage 34 and implement 36 about the respective axes 42 and 44 defines the path through space traversed by implement 36. Accordingly, control signals output to actuator 40 may command a speed of rotation of implement 36 about axis 44 which is responsive to a commanded speed of rotation of linkage 34 about axis 42. From Step 155, the process may proceed to Step 160 at which electronic control unit 74 may command adjustment of lift arm and/or bucket control valve actuators 57 and 59. From Step 160, the process may proceed to end at Step 165. The process might also loop back subsequent to Step 160, to execute again the portion of the control process beginning at Step 130. As implement system 12 approaches the hovering configuration, feedback from sensors 76 and 78 may be used in a closed loop fashion to determine that a set point, i.e. the hovering configuration, has indeed been reached. In general terms, the present control strategy may be understood as closed loop position control, but using the stored gain values as discussed above as or analogously to feed forward terms to enable implement system 12 to assume a hovering configuration without colliding with substrate 200.

The present description is for illustrative purposed only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspect, features and advantages will be apparent upon an examination of the attached drawings and appended claims.

What is claimed is:

1. A method of controlling a hydraulically actuated implement system having a linkage and an implement, in a self-propelled ground engaging machine having a frame where the linkage is rotatable about a first axis relative the frame via a first hydraulic actuator and the implement is rotatable about a second axis relative the frame via a second hydraulic actuator, the method comprising the steps of:

electronically reading via an electronic control unit a stored gain which is linked with a starting configuration of the implement system, responsive to an implement hover command;

outputting a first control signal from the electronic control unit which is based at least in part on the stored gain to a first electrical actuator coupled with a first control valve for the first hydraulic actuator;

outputting a second control signal from the electronic control unit to a second electrical actuator coupled with a second control valve for the second hydraulic actuator; and actuating the implement system via adjustment of the first electrical actuator responsive to the first control signal and adjustment of the second electrical actuator responsive to the second control signal, such that the implement system is moved via the first and second hydraulic actuators according to a substrate collision avoiding pattern from the starting configuration to a second configuration at which the implement hovers above a substrate beneath the machine;

the actuation of the implement system further including moving the linkage at a speed of rotation about the first axis commanded via the first control signal, and moving the implement at a speed of rotation about the second axis commanded via the second control signal and being dependent upon the commanded speed of rotation of the linkage; and determining the first control signal such that the commanded speed of rotation of the linkage from the starting configuration is less than a maximum speed of rotation of the linkage.

2. The method of claim 1 further comprising a step of receiving the implement hover command while the linkage is raised, and wherein the step of actuating further includes lowering the implement system from the starting configuration to the second configuration.

3. The method of claim 2 further comprising a step of receiving data indicative of a starting linkage state, the starting configuration being defined at least in part by the starting linkage state from among a plurality of possible starting configurations.

4. The method of claim 3 wherein the linkage includes a lift arm and the implement includes a bucket, and wherein the step of receiving data further includes receiving data indicative of position, travel speed, and travel direction, of the lift arm.

5. The method of claim 4 wherein the step of actuating further includes tilting the bucket responsive to the starting linkage state.

6. The method of claim 3 wherein the step of electronically reading further includes reading the stored value gain at an address having a starting linkage state coordinate.

7. The method of claim 6 wherein the step of electronically reading further includes reading the stored value gain at an address having an implement type coordinate.

8. The method of claim 7 wherein the step of receiving the implement hover command includes receiving the command from an operator input device having a total of two different states.

9. The method of claim 1 wherein the step of actuating further includes actuating the implement system such that the implement hovers at a height above the substrate which is less than about 5% of a maximum lift height of the implement, during forward travel of the machine.

10. A control system for a hydraulically actuated implement system having a linkage and an implement rotatable relative one another and relative a machine frame, in a self-propelled ground engaging machine, comprising:

a first electrical control valve actuator;

a second electrical control valve actuator;

a computer readable memory storing a gain linked with a starting configuration of the implement system;

an electronic control unit coupled with the computer readable memory and configured to read the stored gain, in response to an implement hover command; and the electronic control unit being in control communication with the first and second electrical control valve actuators, and being further configured to determine and output a first control signal to the first electrical control valve actuator which is based at least in part on the stored gain and commands a first speed of rotation of the linkage, and to determine and output a second control signal to the second electrical control valve actuator which commands a second speed of rotation of the implement which is dependent upon the first speed, and where the commanded speed of linkage rotation from the starting cg is less than a maximum speed of linkage rotation; and the electronic control unit being further configured to actuate the implement system via the first and second control signals, such that the implement system is moved via first and second hydraulic actuators controlled by the first and second electrical control valve actuators, respectively, according to a substrate collision avoiding pattern from the starting configuration to a second configuration at which the implement hovers above a substrate beneath the machine.

11. The control system of claim 10 wherein the gain is one of a plurality of gains stored on the computer readable memory and each being linked to a different one of a plurality of possible starting configurations of the implement system.

12. The control system of claim 11 wherein each of the plurality of stored gains has an address on the computer readable memory including a starting linkage position coordinate, whereby the plurality of stored values gains are linked to the plurality of possible starting configurations.

13. The control system of claim 11 wherein the electronic control unit is further configured to receive data indicative of a throttle position in the machine and to output the control signal responsive to the data indicative of throttle position.

14. The control system of claim 11 further comprising a sensor configured to sense a position of the linkage, and wherein the electronic control unit is coupled with the sensor and configured to read the stored value responsive to a sensed starting position of the linkage.

15. The control system of claim 14 wherein the first electrical control valve actuator is coupled with a control valve for a lift actuator of the linkage and the second electrical control valve actuator is coupled with a control valve for a tilt actuator of the implement.

16. The control system of claim 15 wherein the substrate collision avoiding pattern is defined in part by a speed of rotation of the linkage about a pivot axis with the machine and in part by a speed of rotation of the implement about a pivot axis with the linkage.

17. A machine comprising:

a frame;

ground engaging propulsion elements coupled with the frame;

a hydraulically actuated implement system having a linkage rotatable relative the frame about a first axis and an implement rotatable relative the linkage about a second axis, a first electrical actuator coupled with a first control valve for a linkage hydraulic actuator, and a second electrical actuator coupled with a second control valve for an implement hydraulic actuator;

the first control valve being movable via the first electrical actuator among a plurality of positions including a first position corresponding to a maximum speed of rotation of the linkage and a second position corresponding to a speed of rotation less than the maximum speed;

an electronic control unit in control communication with the first and second electrical actuators and configured to adjust the implement system from a starting configuration to a second configuration at which the implement hovers above a substrate beneath the machine; and the electronic control unit being further configured to receive data indicative of the starting configuration and responsively adjust the implement system via the linkage and implement hydraulic actuators from the starting configuration to the second configuration according to a substrate collision avoiding pattern via outputting a first control signal to the first electrical actuator commanding a first speed of rotation of the linkage from the starting configuration and a second control signal to the second electrical actuator commanding a second speed of rotation of the implement which is dependent upon the commanded first speed; and the electronic control unit being further configured to determine the first control signal such that the first control valve is responsively moved to the second position and the commanded first speed of rotation is less than the maximum speed.

18. The machine of claim 17 comprising a wheel loader wherein the linkage includes a lift arm and the implement includes a bucket, and further comprising a sensor group configured to sense a position of the lift arm and a position of the bucket in a reference frame defined by the machine; and wherein the electronic control unit is further configured to adjust the implement system to the second configuration responsive to the sensed positions such that the implement hovers at a height above the substrate which is less than about 5% of a maximum lift height of the implement.

* * * * *

UNITED STATES PATENT AND TRADEMARK OFFICE

CERTIFICATE OF CORRECTION

PATENT NO. : 8,843,282 B2
APPLICATION NO. : 13/287334
DATED : September 23, 2014
INVENTOR(S) : David C. Atkinson It is certified that error appears in the above-identified patent and that said Letters Patent is hereby corrected as shown below:

In the Claims

Column 10, line 57, in Claim 6, delete “value gain” and insert -- gain --.

Column 10, line 60, in Claim 7, delete “value gain” and insert -- gain --.

Column 11, line 43, in Claim 12, delete “values gains” and insert -- gains --.

Signed and Sealed this
Twenty-second Day of September, 2015

Michelle K. Lee

Michelle K. Lee
*Director of the United States Patent and Trademark Office*